US006458435B1

(12) United States Patent
Lai

(10) Patent No.: US 6,458,435 B1
(45) Date of Patent: Oct. 1, 2002

(54) ARTIFICIAL TREE

(75) Inventor: Jimmy Kam-Wing Lai, Kwai Chung (HK)

(73) Assignee: FT Far East Limited, Hong Kong (HK)

( * ) Notice: Subject to any disclaimer, the term of this patent is extended or adjusted under 35 U.S.C. 154(b) by 0 days.

(21) Appl. No.: 09/497,095

(22) Filed: Feb. 3, 2000

(51) Int. Cl.[7] ..... A41G 1/00

(52) U.S. Cl. ..... 428/20; 428/18; 428/27; 362/806; 362/123; 362/32

(58) Field of Search ..... 428/18, 20, 27; 362/123, 122, 32, 806

(56) References Cited

U.S. PATENT DOCUMENTS

| | | | | | |
|---|---|---|---|---|---|
| 3,278,364 | A | | 10/1966 | Dieffenbach | 161/22 |
| 3,594,260 | A | | 7/1971 | Dieffenbach | 161/24 |
| 3,811,991 | A | | 5/1974 | Dieffenbach | 161/24 |
| 3,819,457 | A | | 6/1974 | Mottel | 161/14 |
| 4,068,118 | A | | 1/1978 | Carrington | 362/123 |
| 4,101,697 | A | * | 7/1978 | Dieffenbach et al. | |
| 4,396,652 | A | * | 8/1983 | Koehler | |
| 4,659,597 | A | | 4/1987 | Lau | 428/9 |
| 4,878,157 | A | | 10/1989 | Koch | 362/123 |
| 5,104,608 | A | * | 4/1992 | Pickering | |
| 5,306,366 | A | * | 4/1994 | Shattan | |
| 5,422,797 | A | | 6/1995 | Shattan | 362/123 |
| 5,517,390 | A | * | 5/1996 | Zins | |
| 5,558,422 | A | * | 9/1996 | Sanford | |
| 5,702,170 | A | * | 12/1997 | Broderick | |
| 5,820,248 | A | | 10/1998 | Ferguson | 362/123 |
| 5,829,863 | A | | 11/1998 | Gutshall | 362/123 |
| 6,093,459 | A | | 7/2000 | Puleo | 428/20 |

* cited by examiner

*Primary Examiner*—Deborah Jones
*Assistant Examiner*—Wendy Boss
(74) *Attorney, Agent, or Firm*—Sheridan Ross PC

(57) ABSTRACT

An artificial tree has a central trunk, a number of main branches suspended from an upper portion of the trunk in a downwardly and outwardly inclined orientation, and a pre-formed tree top section extending upwardly from the upper portion of the trunk. Each main branch includes a number of sub-branch clusters and a bundle of fiber optic conduits which terminate in the sub-branches. The bundles of fiber optic conduits are received in an opaque enclosure housing a high intensity light source, which enclosure is attached to the upper portion of the trunk. Electric lights are disclosed as an alternative means to illuminate the tree. The trunk includes upwardly open hook elements which receive pin elements within the interior of rigid support members of the main branches. Each sub-branch cluster is pivotally connected to an associated rigid support member to articulate between a collapsed position for storage and shipping, and an extended position for display.

12 Claims, 8 Drawing Sheets

ARTIFICIAL TREE

FIELD OF THE INVENTION

This invention relates to the field of artificial trees and in particular, to illuminated artificial trees which can be assembled by the user.

BACKGROUND AND SUMMARY OF THE INVENTION

Artificial trees are widely used due to many factors including their durability, cost efficiency and consistent appearance. A well known occasion for use of artificial trees is the Christmas season wherein trees are customarily illuminated.

Artificial trees are often constructed such that they can be shipped in a disassembled state and assembled by the user at the desired location. Prior designs have provided various ways of removably attaching branches to a vertical support trunk. The branches themselves are typically constructed from twisted wire into which synthetic plastic strips simulating pine needles have been woven.

The methods of illuminating artificial trees include the use of (e.g., incandescent) lights directly visible to the viewer as well as the use of fiber optic elements which transport light from a central light source to various locations on the tree, thereby creating a plurality of points of light from the single source. To date the prior designs of illuminated artificial trees have been sufficient. However, the novel illuminated artificial tree of the present invention provides an improvement over the past designs.

The illuminated artificial tree of the present invention includes a rigid central trunk to which a number of main branches (or "panels") are attached. Each main branch is comprised of a rigid support member, such as metal tubing, and is removably connected to the top of the center trunk member of the tree and such that it hangs downwardly therefrom. The main branches support a number of discrete sub-branch clusters which can, for example, include synthetic needles or leaves.

A collapsible support is detachably connected to the central trunk member of the tree adjacent a lower or middle portion thereof and engages a lower portion of each main branch to support the branch in an inclined position.

A number of main branches are suspended from the central trunk member of the tree thereby partially forming the conical shape of a developed evergreen tree. A pre-formed tree top section, also having a number of sub-branches, is attached to and extends upwardly from the center trunk of the tree to complete the conical shape of a fully formed evergreen tree.

The main branches (or "panels") and the pre-formed top section can also include illumination sources, such as directly visible lights, or, alternatively, fiber optic elements. In the case of directly visible lights, the main branches and the tree-top include electrical conductors (e.g., wires) which provide electric power to lights within the sub-branches. Preferably, the tree includes a number of outlets adjacent the point where the main branches connect to the central trunk of the tree, which are suitable for electrical connection to the electrical conductors. An electrical power source is connected to the outlets to provide electrical power to the light sources.

In the case of fiber optic illumination sources, the main branches and the tree-top include a number of fiber optic conduits which are terminated within the sub-branches. The fiber optic conduits form a bundle which extends along the support members of the main branches (and of the tree-top) toward the point of connection to the central trunk member of the tree.

A central light source (e.g. a single, high-intensity light) is connected to the central trunk member of the tree adjacent the point where the main branches and tree-top attach to the central trunk of the tree. The light source is enclosed in an opaque enclosure which includes a number of openings, each of which receives one of the bundles of fiber optic conduits. The light source shines onto the ends of bundles of fiber optic conduits, which guide the light to the ends of the conduits, thereby forming a plurality of decorative points of light.

The central light source can also include a light concentrator, such as a mirror and means to vary to intensity, duration or color of the light projected onto the bundles of fiber optic fiber optic conduits.

The sub-branches of each main branch are preferably pivotably mounted to the support member of the branches, such that the main branches can be collapsed for shipping and storage. The pivotal connection between the sub-branches and the support member of the main branches is designed such that the sub-branches are constrained to pivot between a collapsed position and an extended position.

In the collapsed position the sub-branches fold against themselves and the support member of the main branch, and are aligned parallel or nearly parallel to the support member of the main branch pointing toward the "top" of the main branch.

Preferably, the sub-branches are loosely pivotally-connected to the support members such that when the main branches and suspended from the central trunk member of the tree, gravity will naturally pull the sub-branches downwardly into the extended position thereby forming the desired shape of the main branches.

For a more complete understanding of the above and other features and advantages of the invention, reference should be made to the following detailed description of preferred embodiments of the invention and to the accompanying drawings.

DETAILED DESCRIPTION OF THE INVENTION

Figure 1:
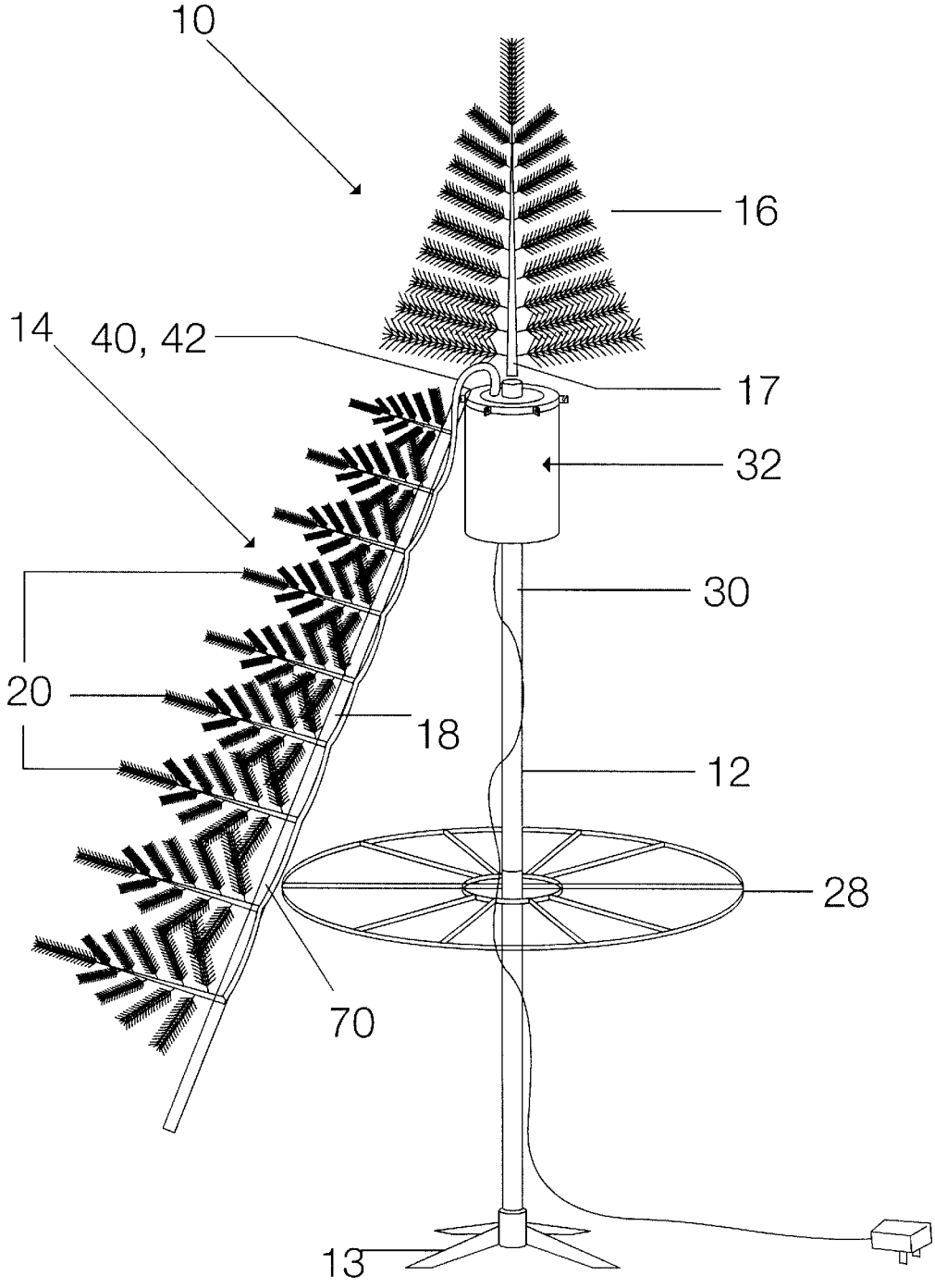
FIG. 1 is a front elevation partial assembly view of an artificial tree of the present invention.
Figure 2:
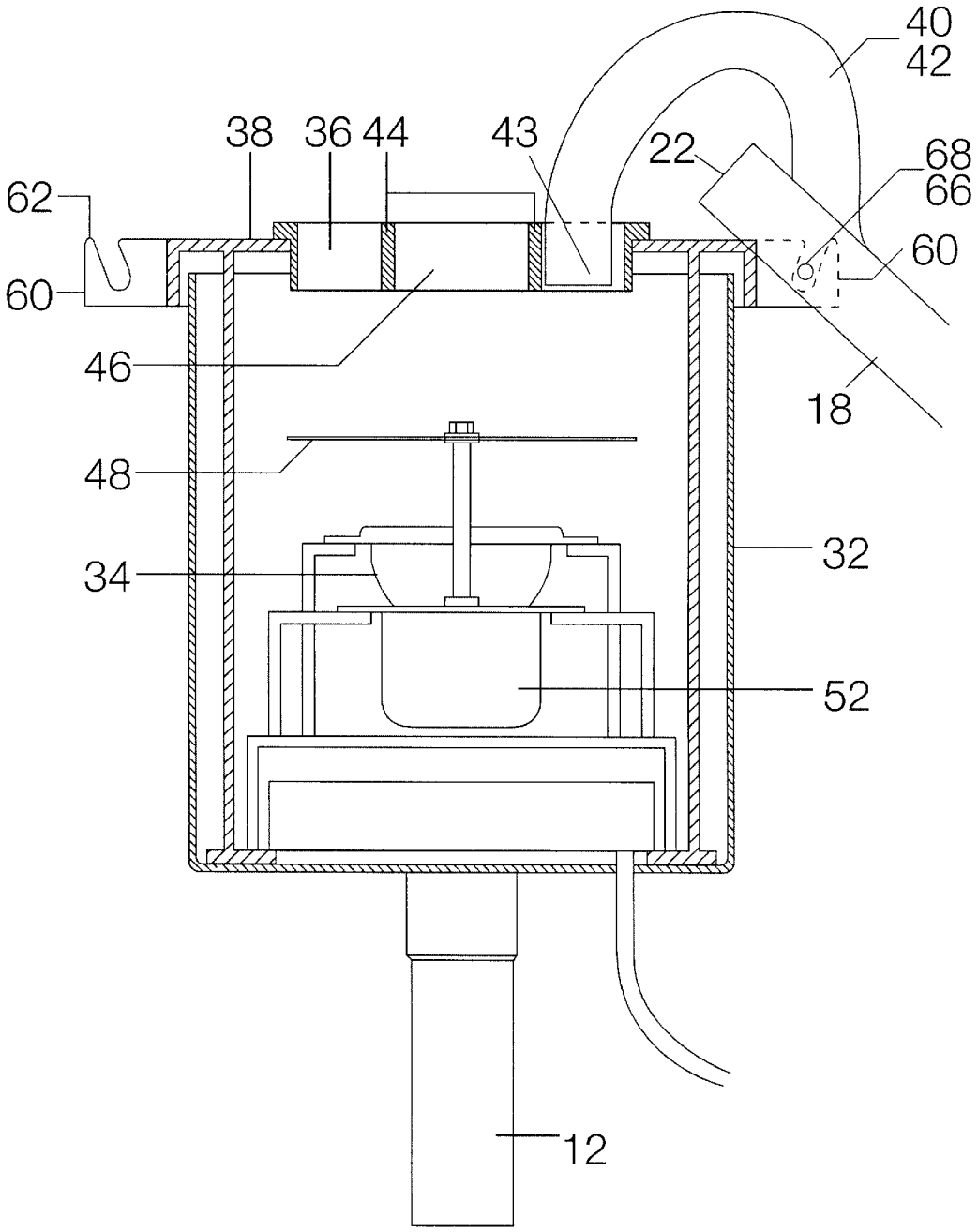
FIG. 2 is a cross-sectional view of the central light source of the artificial tree of FIG. 1.

Referring to FIGS. 1 and 2 the artificial tree 10 of the present invention preferably includes a central trunk 12, a plurality of main branches 14 (or "branch panels"), and a pre-formed tree-top section 16.

Each main branch 14 includes an elongated rigid support member 18, such as hollow rectangular aluminum tubing, and a number of discrete sub-branch clusters 20 disposed along the length of the support member 18. Preferably, the sub-branch clusters 20, and the tree-top section 16 include simulated foliage, such as that formed by weaving synthetic material into wire braids to form simulated evergreen needles.

The trunk 12 preferably includes an enclosure 32 housing a source of light 34. The enclosure 32 includes a number of holes 36, preferably in a top portion 38 thereof through which light from the source of light 34 can pass, however, the enclosure 32 is preferably otherwise opaque.

Each main branch 14 preferably includes a number of fiber optic conduits 40 (e.g. 4–10), each having an end terminating in one of the branches of the sub-branch clusters 20. The fiber optic conduits 40 are preferably permanently affixed to and extend upwardly along the support member 18 of the main branch 14 forming a bundle of conduits 42, which can be protected an enclosure (not shown).

Each bundle of fiber optic conduits 42 extends a predetermined distance beyond a top portion 22 of the main branch 14 and extends into a fiber optic conduit retainer 44 which retains the bundle of conduits 42 in alignment with one of the holes 36 in the enclosure 32, such that an extreme end 43 of the bundle of conduits 42 is exposed to light emitted from the source of light 34.

The conduit retainers 44 can be integrally formed with the enclosure 32, surrounding the holes 36 therein. Also, preferably, each conduit retainer 44 is sized and shaped to closely removably retain the end 43 of the bundle of conduits 42, for example, by tolerance or friction fit, such that the bundle of conduits 42 can be easily inserted and removed from the retainer 44 during installation and removal of the tree 10.

The enclosure can also include a tree-top mounting opening 46, preferably aligned with the longitudinal axis of the trunk 12, for receiving and removably retaining the center support 17 of the pre-formed tree-top section 16. The tree-top section 16 can include fiber optic conduits (not shown), similar to those of the main branches 14, inside or on the periphery of the center support 17, and the mounting opening 46 can be sized and shaped to closely receive and removably retain the center support 17 and the conduits.

The tree 10 can also include a means to dynamically vary or alter characteristics (i.e., color, duration, intensity) of the light emitted by the tree, such as a rotating color and/or aperture wheel 48 disposed between the source of light 34 and the holes 36 in the enclosure 32. The rotating wheel 48 can be driven by a motor 52 also housed within the enclosure 32. Preferably, if a rotating wheel 48 is employed to alter the light emitted by the tree 10, the holes 36 in the enclosure 32 are spaced at substantially equal angular intervals around the axis of rotation of the wheel 48.

Referring to FIGS. 1–4, the main branches 14 are substantially identical and each is attached to the trunk 12 at an equivalent height above a base 13 thereof, in a downwardly and outwardly inclined orientation. The main branches are preferably disposed around a longitudinal axis of the trunk 12 at regular angular intervals thereby forming a partially conical shape. The pre-formed tree-top section 16 includes a rigid center support 17 which attaches to the trunk 12 above the main branches 14 and extends upwardly therefrom to complete the desirable conical shape of a fully formed evergreen.

Specifically, the top portion 22 of each main branch 14, when releasably attached to the trunk 12, is located a predetermined perpendicular (i.e., horizontal) distance from the longitudinal axis of the trunk 12. A lower support 28, attached to the trunk 12 below a top portion 30 thereof, extends radially outwardly and contacts each main branch 14 at a distance from the longitudinal axis, which distance is greater than the predetermined distance at which the top portion 22 is located.

The trunk 12 of the tree 10 includes branch support structure 60 which releasably engages the top portion 22 of the support members 18 of the main branches 14, such that the main branches are suspended (downwardly) from the support structure 60.

Lower portions 70 of the main branches 14 contact and rest against the lower support 28, which is connected to the trunk 12. The lower support 28 can include structure, such as recesses, ridges, or projections or the like, to limit the sliding (or lateral) movement of the lower portions 70 of the main branches 14 with respect to the lower support.

Preferably, the branch support structure 60 is in the form of a number of upwardly-open hook elements 62 which are integrally formed with the enclosure 32. The hook elements 62 are preferably regularly angularly disposed around the longitudinal axis of the trunk, and outwardly radially spaced from the trunk 12 at a substantially constant distance.

Figure 3:
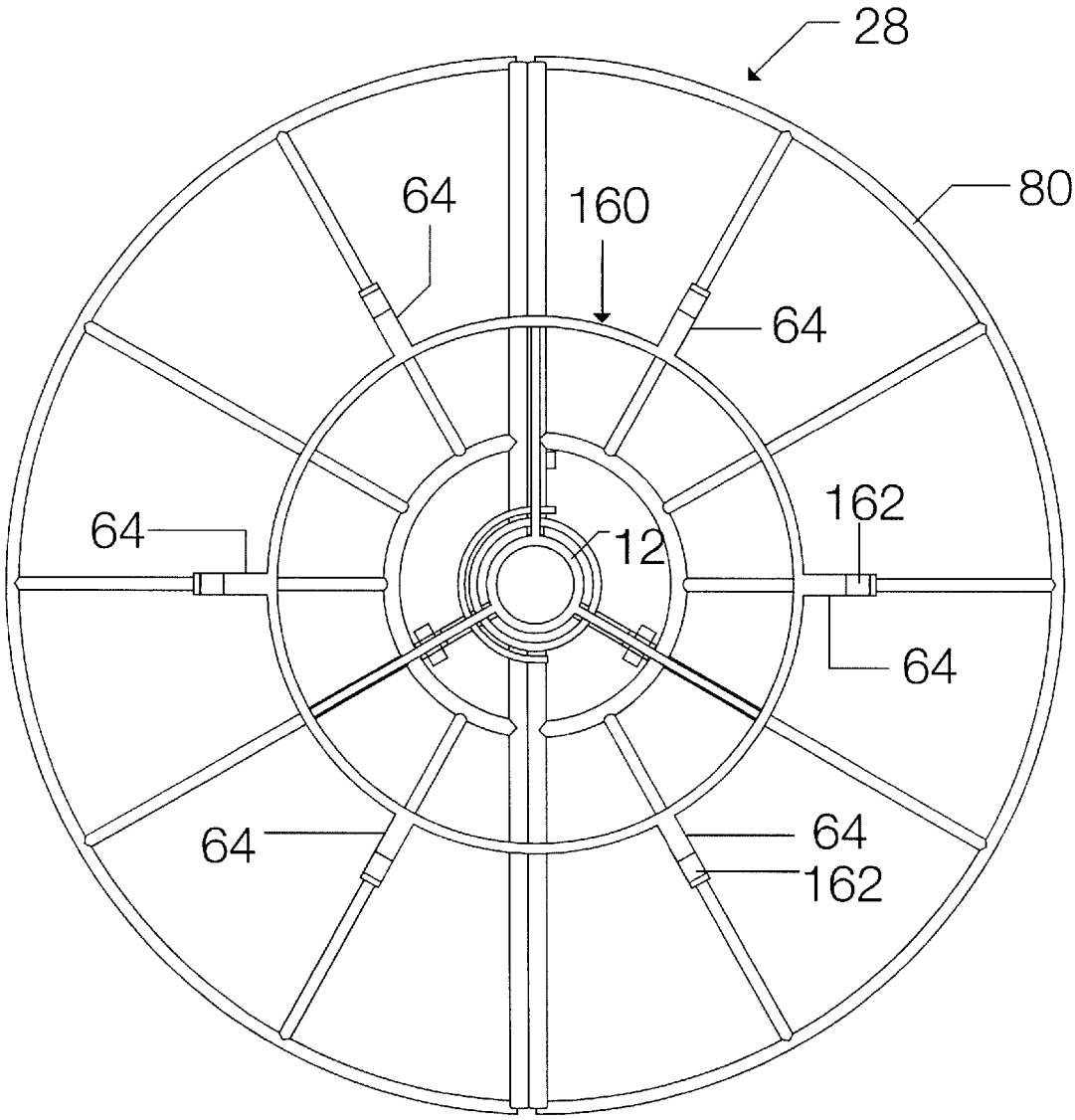
FIG. 3 is a top plan view of the central trunk member.
Figure 4:
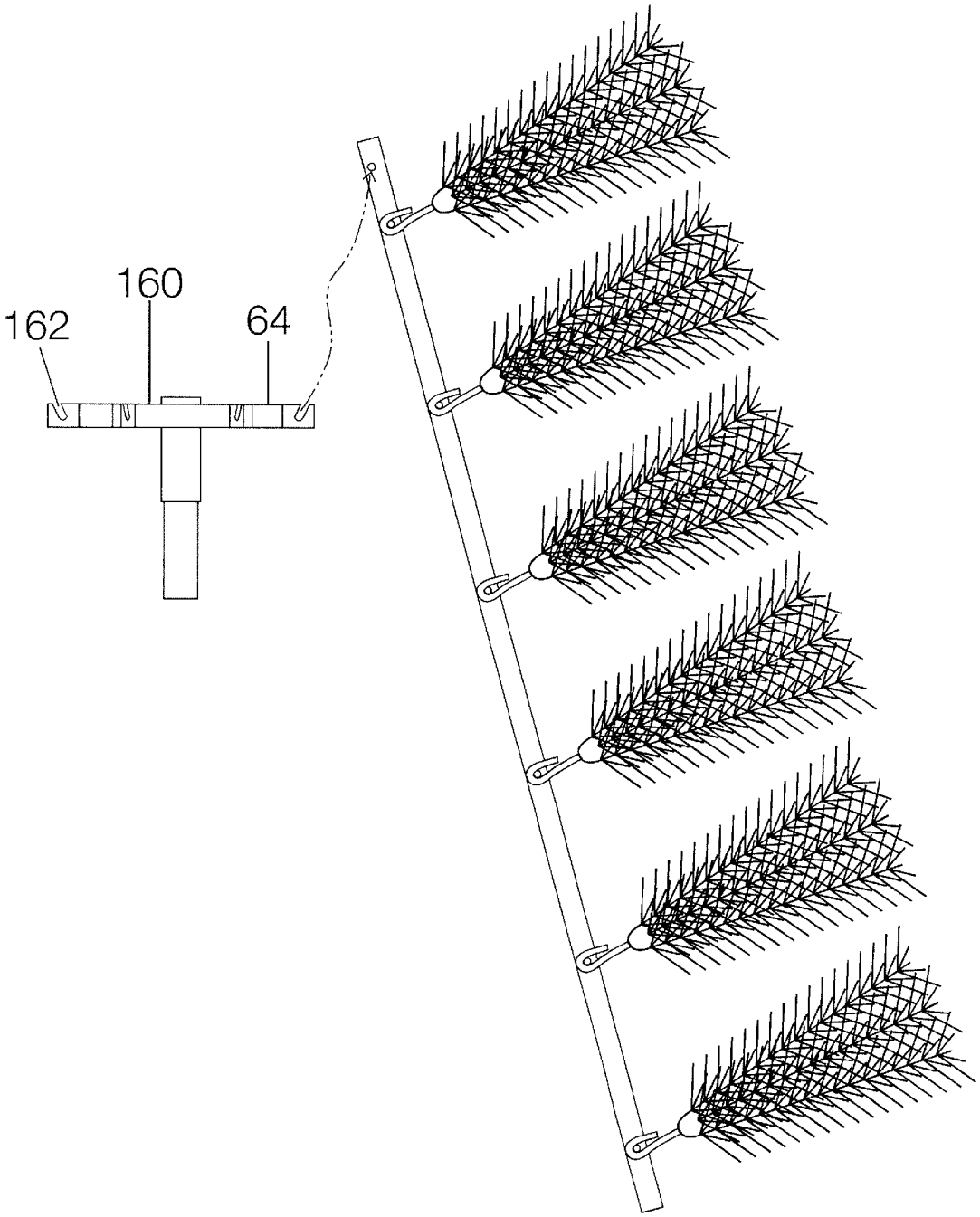
FIG. 4 is a front elevational view of a main branch attached to the central trunk member

As shown in FIGS. 3 and 4, the branch support structure 160 can alternatively be in the form of a support ring 64 having a number of hook elements 162 connected to, or integral therewith.

Referring to FIG. 2, each main branch 14 includes a hook-engaging element 66, such as a pin element 68 shown, which is received by one of the hook elements 62 to suspend the main branch 14 from the trunk 12.

Most suitably, the support structure 60 and main branch 14 include means to prevent accidental or unintended disengagement of tree branch. For example, support member 18 of the main branch 14 can be comprised of hollow tubing with the pin element 68 located within an interior thereof. The support member 18, in which case, includes an opening in the outer walls of the support member 18, adapted to receive the hook element 62 of the branch support structure 60 therein, the hook element engaging the pin element. In this manner, each main branch 14 is effectively suspended from the trunk 12, and the outer walls of the support member 18 serve to reduce or eliminate accidental disengagement of the main branches.

Figure 5:
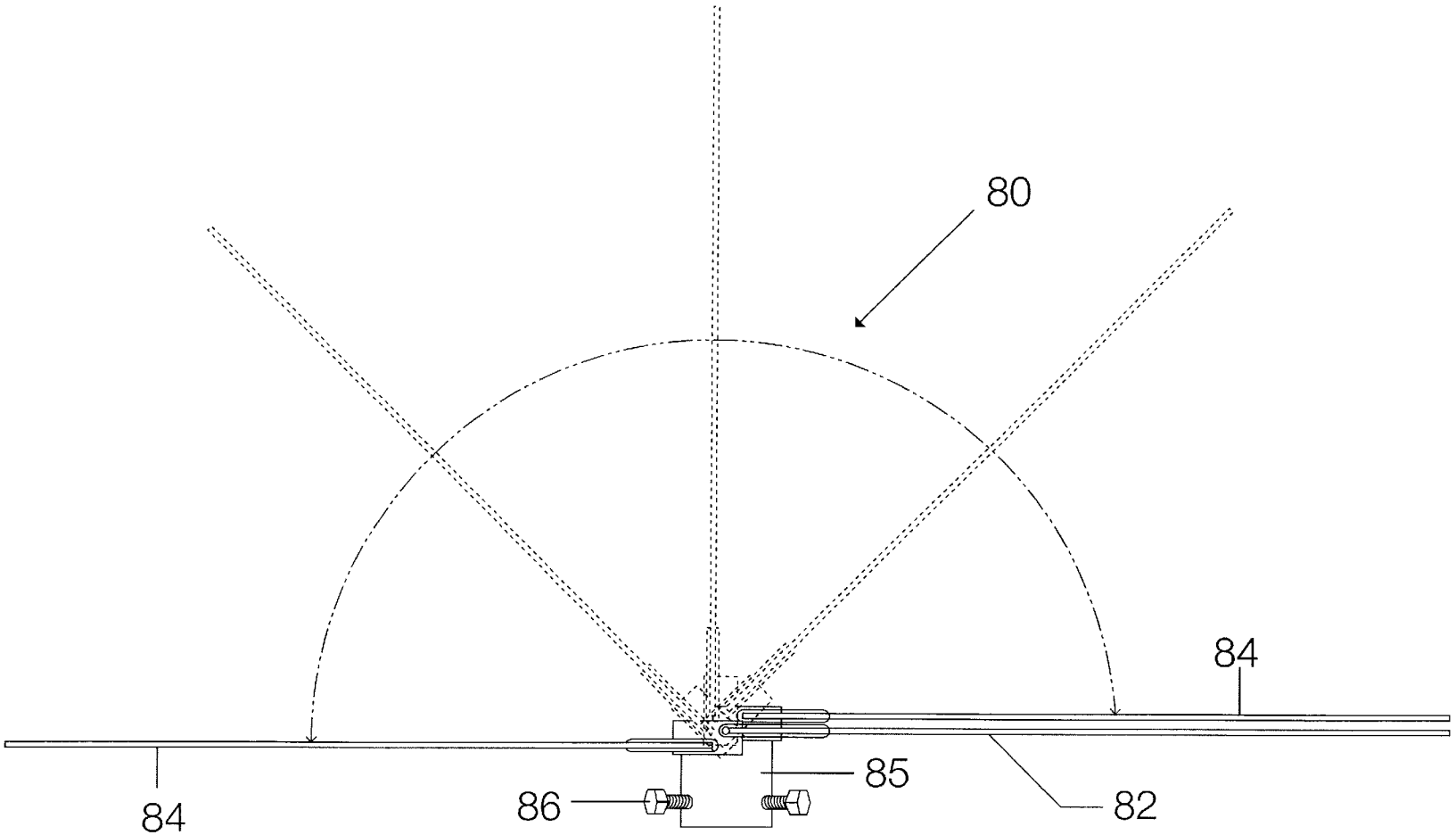
FIG. 5 is a side elevational view of the collapsible support ring.

Referring to FIGS. 1 and 5, the lower support 28 can be in the form of a support ring 80 extending radially outwardly from the trunk 12. As depicted in FIG. 5, the support ring 80 can be comprised of a fixed semi-ring 82 and an articulated semi-ring 84. The fixed semi-ring 82 being fixedly connected to an attachment ring 85 suitable for attachment to the trunk, and the articulated semi-ring 84 being pivotally connected to the attachment ring 85, such that the support ring 80 can be stored and shipped in a collapsed positioned separated from the trunk 12. The attachment ring 85 can include any suitable means for attachment to the trunk 12, such as the pressure screws 86 depicted.

Figure 6:
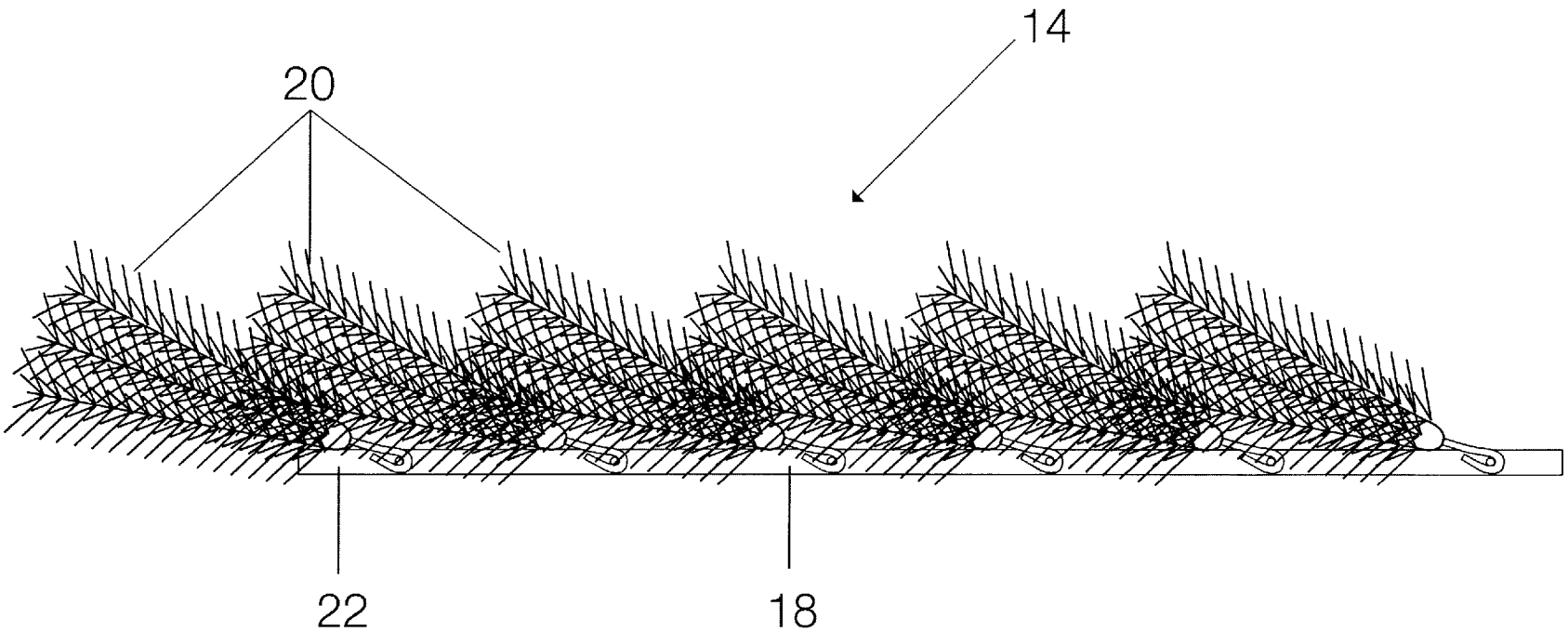
FIG. 6 is a side elevational view of a branch panel in the collapsed position.

Referring to FIGS. 1 and 6–8, the sub-branch clusters 20 are preferably pivotally attached to the support members 18 such that the sub-branch clusters articulate between an extended position (as shown in FIG. 1), and a collapsed position, for storage and shipping (as shown in FIG. 6).

In the extended position (FIG. 1), the sub-branches 20 project outwardly from the support member 18 and are substantially separated. Preferably, the sub-branches 20 are loosely pivotally connected to the support member 18 such that, when the main branch 14 is suspended from the trunk 12 by the top portion 22 of the support member 18, each sub-branch 20 naturally falls into the extended position shown, under the force of gravity.

In the collapsed position (FIG. 6), the sub-branches 20 lay flat such that they are in substantial contact with one another and are aligned substantially parallel (or nearly parallel) to a longitudinal axis of the support member 18 of the main branch, toward the top portion 22 of the main branch 14 (i.e., the portion which attaches to the trunk 12). The angle at which each sub-branch 20 is oriented in the collapsed position, with respect to the support member, is substantially less than the same angle in the extended position.

As can be appreciated, each main branch 14 occupies less space in the collapsed position than in the extended position. Thus, in the collapsed position, the main branches 14 can be shipped or stored more efficiently and with less chance of damage.

Figure 7:
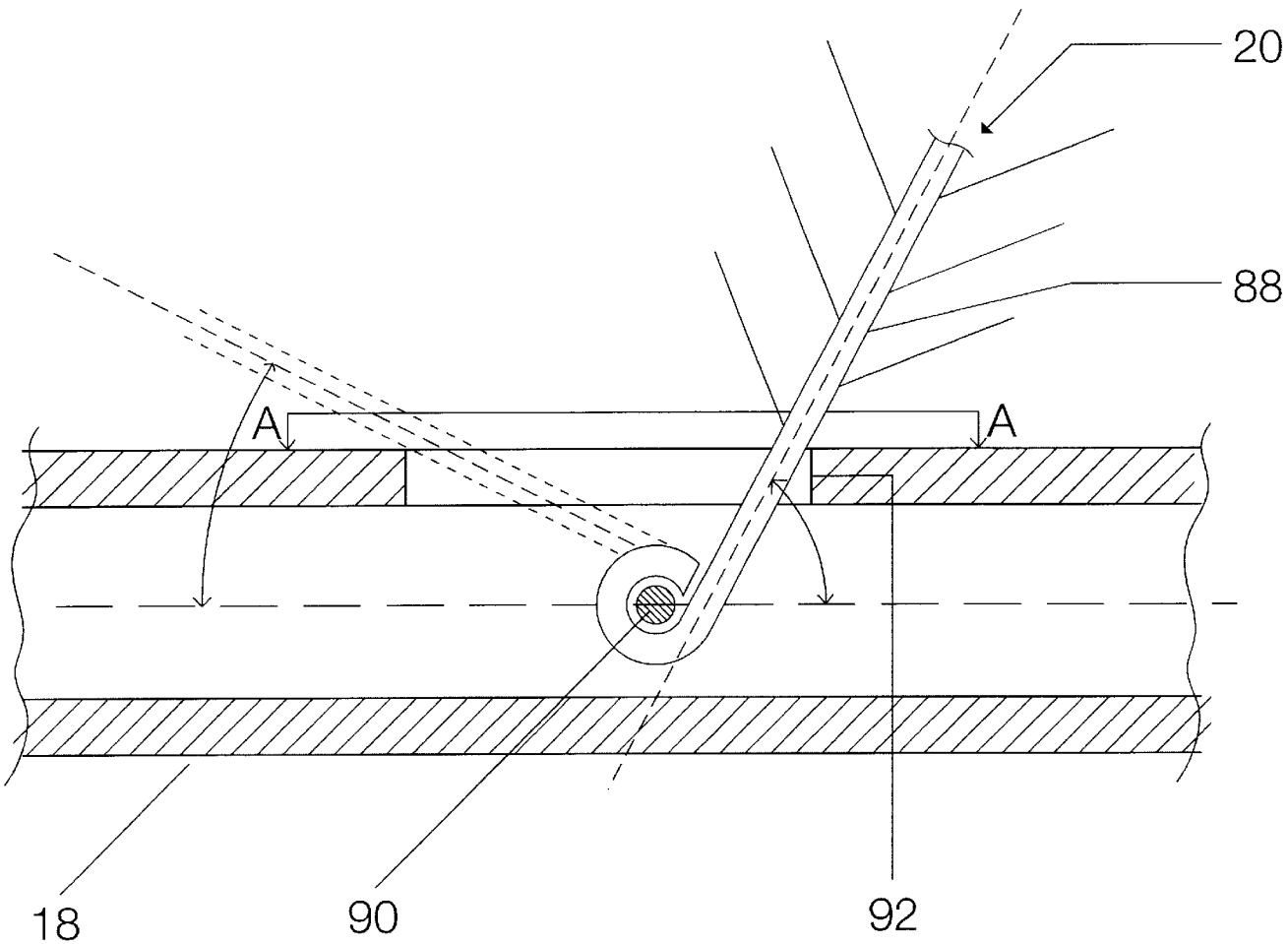
FIG. 7 is a close-up, cross-sectional side elevational view of a main branch showing the pivotal connection of a sub-branch.
Figure 8:
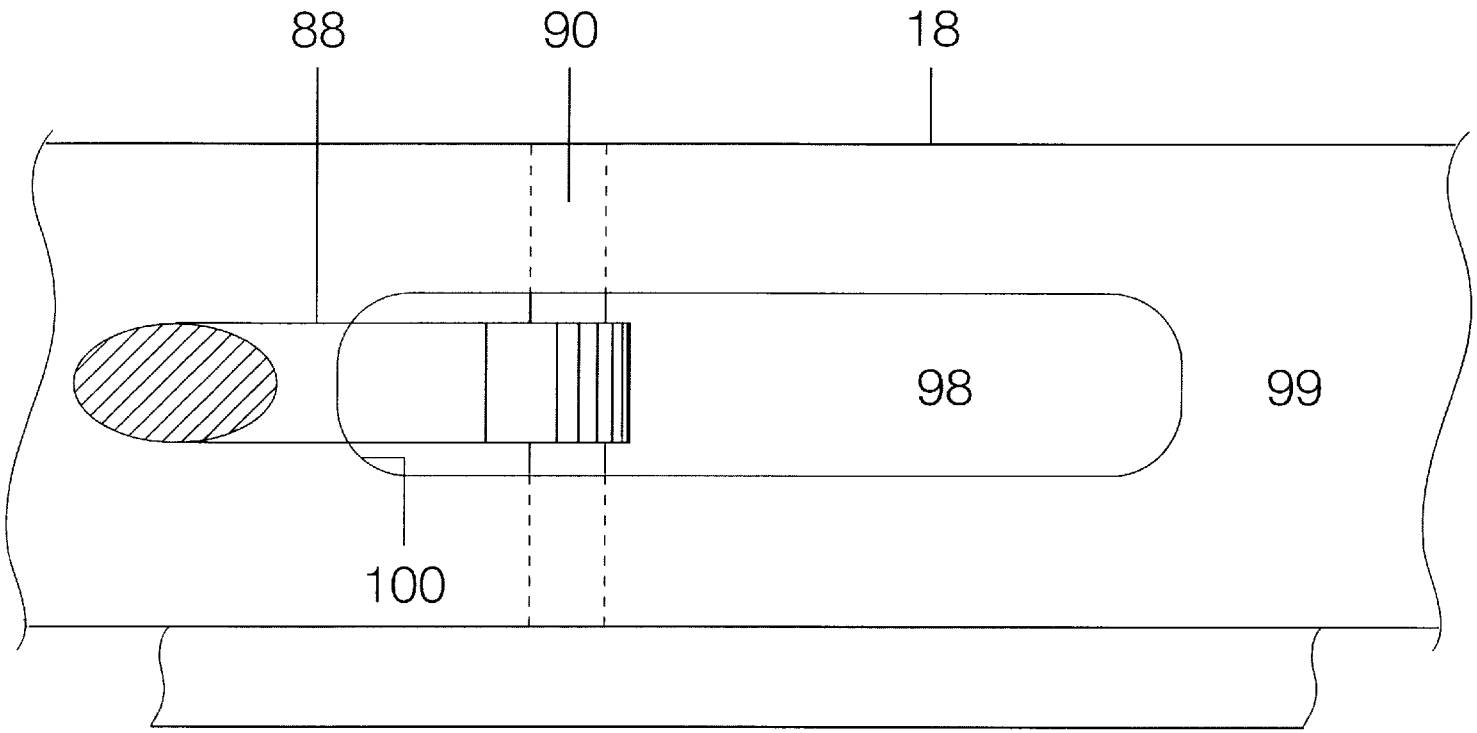
FIG. 8 is a close-up cross-sectional top plan view of the pivotal connection of FIG. 7.

Referring to FIGS. 7–8 each sub-branch 20 includes a stem portion 88 which is pivotally connected to the support member 18 of the main branch 14 at a pivot point 90. The main branch 14 preferably includes a stop 92 which engages the stem portion 88 of the sub-branch 20 in the extended position to limit the (downward) pivotal movement of each sub-branch 20 when the main branch 14 is suspended from the trunk 12. The pivot point 90 can be a pivot pin located inside the support member 18, and supported by side walls at 96, thereof. Stem portion 88 extends out of an opening 98 in a top wall 99 of the support member 18. An edge 100 of the opening 98 contacts the stem portion 88, when the sub-branch 20 is in the extended position to limit the pivotal movement of the sub-branch 20.

The fiber optic conduits (or electrical wires) are provided with sufficient slack between points of attachment to the support member 18 and the branch cluster stem to allow each cluster to pivot between the collapsed and extended positions.

In an alternative embodiment, each main branch 14 includes lights (e.g., incandescent lights), the light from which can be viewed directly by the viewer. Electrical conductors extend upwardly, along the support member 18 of the main branch 14 and preferably terminate with an electrical plug. The electrical conductors can be enclosed within a protective cover (not shown). A number of electrical outlets are attached to the trunk 12 adjacent the branch support structure 60 and are suitable for receiving one of the electrical plugs of the main branches.

The artificial tree 10 can be shipped or stored in a disassembled, collapsed state, with the main branches 14 and the support ring 80 in collapsed positions. To assemble the tree 10, the trunk 12 is assembled, if necessary, then the support ring 80 is attached to the trunk 12 and secured in an open position. In the next step the main branches 14 are suspended from the trunk 12 by attaching the top portion 22 of the main branches 14 to the branch support structure 60, with the lower portions of the support members 18 thereof resting on the support ring 28. Next, the fiber optic conduit bundles are inserted into the conduit retainers. Or, the electrical conductors (for directly visible lights) are plugged into the associated electrical outlets. Finally, the preformed tree-top section is attached to the trunk 10 and power is applied.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An artificial tree comprising:

a rigid central trunk member having a base portion;

a plurality of main branches each having a rigid support member with top and bottom portions and a number of clusters of sub-branches disposed along a length of said support member;

said trunk member and said top portions of said main branches including means to removably mount said main branches to said central trunk member, said means to removably mount said main branches to said central trunk member being suitable to support said top portion of each main branch a first predetermined perpendicular distance from a vertical longitudinal axis of said central trunk member;

means to support said bottom portions of said main branches a second predetermined perpendicular distance from said vertical longitudinal axis of said central trunk member, said second predetermined distance being greater than said first predetermined distance such that, when mounted to said central member, said main branches are aligned downwardly and outwardly;

wherein each main branch includes a set of fiber optic conduits, each conduit having a first end portion terminating in one of said clusters of sub-branches, having an intermediate portion extending along said length of said support member of said main branch, and having a second end portion;

a source of light is connected to said central trunk member, said source of light being enclosed in an opaque enclosure;

said opaque enclosure having a number of openings suitable to permit the passage of light therethrough, said source of light being suitable to project light through said openings in said opaque enclosure; and fiber optic conduit retainers suitable to releasably retain said second end portions of said sets of fiber optic conduits in alignment with said openings in said opaque enclosure to expose said second end portions of said sets of fiber optic conduits to light emitted from said source of light.

2. An artificial tree as in claim 1, wherein:

said central trunk member further comprises a top portion and said artificial tree further comprises a pre- formed tree-top portion being removably attachable to said top portion of said central trunk member;

said tree-top portion includes a support member having bottom portion, a number of sub-branches disposed along a length of said support member, a set of fiber optic conduits, each fiber optic conduit having a first end portion terminating in one of said sub-branches of said tree-top portion, having an intermediate portion extending along said length of said support member of said tree-top portion, and having a second end portion; and one of said fiber optic conduit retainers connected to said central trunk member being suitable to releasably retain said second end portions of said set of fiber optic conduits of said tree-top portion in alignment with one of said openings in said opaque enclosure to expose said second end portions of said set of fiber optic conduits of said tree-top portion to light emitted from said source of light.

3. An artificial tree as in claim 1, wherein said means to support said bottom portions of said main branches further comprises a lower support connected to said central trunk member below a top portion thereof, said bottom portions of said support members of said main branches contacting said lower support, and said lower support being spaced radially from said vertical longitudinal axis of said central trunk member a distance sufficient to support said main branches at said second predetermined perpendicular distance from said vertical longitudinal axis.

4. An artificial tree as in claim 3, wherein said means to removably mount said main branches to said central trunk member comprises generally upwardly-open support hooks connected to said central trunk member, said support hooks being radially outwardly spaced from and being angularly disposed around said vertical longitudinal axis of said central trunk member and each main branch comprising a pin member fixedly connected to said top portion of said main branch, said support hooks being suitable to receive said pin members of said main branches.

5. An artificial tree as in claim 1, further comprising a pre-formed tree-top portion, said tree-top portion being removably attachable to a top portion of said central trunk member.

6. An artificial tree as in claim 2, wherein said bottom portion of said support member of said tree-top portion encloses said set of fiber optic conduits.

7. An artificial tree as in claim 1, wherein:

said opaque enclosure includes a top portion having said openings therein;

said fiber optic conduit retainers are integrally formed with said opaque enclosure, each fiber optic conduit retainer surrounds one of said openings and is sized and shaped to closely receive and releasably retain one of said second end portions of said sets of fiber optic conduits.

8. An artificial tree as in claim 7, wherein:

said means to removably mount said main branches to said central trunk member comprises generally upwardly-open support hooks integrally formed with said opaque enclosure, said support hooks being radially outwardly spaced from and angularly disposed around said vertical longitudinal axis of said central trunk member and each main branch comprising a pin member fixedly connected to said top portion of said main branch, said support hooks being suitable to receive said pin members of said main branches.

9. An artificial tree as in claim 1, further comprising:

an optical disc disposed between said source of light and said second end portions of said sets of fiber optic conduits, said optical disc being enclosed within said opaque enclosure; and a motor mechanically connected to said optical disc, said motor being suitable to rotate said optical disc with respect to said sets of fiber optic conduits; and said optical disc including means to vary the characteristics of light projected onto said fiber optic conduits.

10. An artificial tree as in claim 9, wherein:

said opaque enclosure includes a top portion having said openings therein;

said fiber optic conduit retainers are integrally formed with said opaque enclosure, each fiber optic conduit retainer surrounds one of said openings and is sized and shaped to closely receive and releasably retain one of said second end portions of said sets of fiber optic conduits;

said openings and retainers being regularly angularly spaced about an axis of rotation of said optical disc.

11. An artificial tree, comprising:

(a) a support structure;

(b) a-branch panel including;

(i) a rigid, elongated support member having first and second end portions;

(ii) a number of sub-branches clusters disposed along a length of said support member and pivotally connected thereto;

(iii) said sub-branches having a collapsed position wherein said sub-branches are in substantial contact with one another and are aligned toward said first end portion of said support member in a first angular orientation with respect to said support member;

(iv) said sub-branches having an extended position wherein said sub-branches are substantially separated and are aligned in a second angular orientation with respect to said support member, said second angular orientation being greater than said first angular orientation; and (v) means to limit the rotation of each sub-branch with respect to said support member in a direction toward said second end portion such that pivotal movement of said sub-branches with respect to said support member is limited to between said collapsed and said extended position;

(c) said support structure and said first end portion of said support member of said branch panel including means to attach said branch panel to said support structure;

(d) said first end portion of said support member of said branch panel being attached to said support structure and said second end portion thereof being located below said first end portion; and (e) said sub-branches being loosely pivotally connected to said support member such that the force of gravity biases said sub-branches in said extended positions.

12. An artificial tree having a central trunk member, a plurality of main branches removably mounted to said central trunk member, and a number of clusters of sub-branches disposed along a length of each of said main branches, said sub-branches being loosely pivotally connected to said main branches such that the force of gravity biases the sub-branches into an extended position, wherein each main branch includes a set of fiber optic conduits that aligns with one of a plurality of openings provided in an opaque enclosure containing a light source, said light source connected to said central trunk member.

* * * * *